United States Patent [19]

Onishi

[11] 4,336,681

[45] Jun. 29, 1982

[54] METHOD OF TRANSFERRING STRIP-LIKE PLASTICS BAG MATERIAL IN PACKING MACHINE

[75] Inventor: Masami Onishi, Tokyo, Japan

[73] Assignee: Taiyo Shokai Co., Ltd., Japan

[21] Appl. No.: 150,360

[22] Filed: May 16, 1980

[30] Foreign Application Priority Data

May 17, 1979 [JP] Japan ..... 54-59668

[51] Int. Cl.[3] ..... B65B 43/12

[52] U.S. Cl. ..... 53/459; 53/69; 53/76; 53/384; 53/385

[58] Field of Search ..... 53/492, 459, 457, 69, 53/67, 76, 75, 384–386

[56] References Cited

U.S. PATENT DOCUMENTS 3,477,196 11/1969 Lerner ..... 53/459 X
3,481,102 12/1969 Dolman ..... 53/459
3,579,948 5/1971 Lerner ..... 53/459
3,754,370 8/1973 Hanson ..... 53/67 X

FOREIGN PATENT DOCUMENTS 2746126 4/1978 Fed. Rep. of Germany ..... 53/459

*Primary Examiner*—James F. Coan
*Attorney, Agent, or Firm*—McGlew and Tuttle

[57] ABSTRACT

This invention provides a method of transferring a strip-like plastic bag material in a packing machine. The method comprises the steps of transferring the bag material by a pair of intermittently operated pinching rollers. The bag material comprises a series of interconnected bags each having a heat-sealed bottom portion with a flap-like margin. The flap-like margin is raised during transfer of the bag material by guide means. The bottom portion is then detected by means of a microswitch having an elongated contact adapted to be releasably engaged with the flap-like margin as the flap-like margin is raised by the guide means during transfer of said bag material. The bag material is then stopped for a packing operation in response to detection by the microswitch of the bottom portion.

4 Claims, 4 Drawing Figures

FIG. 1
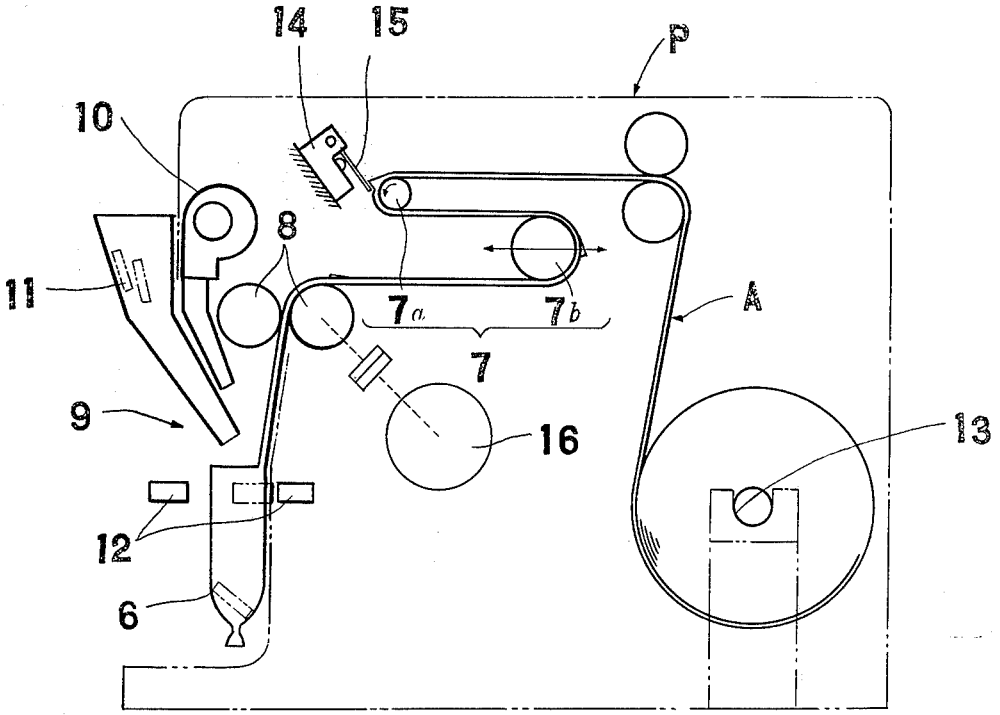
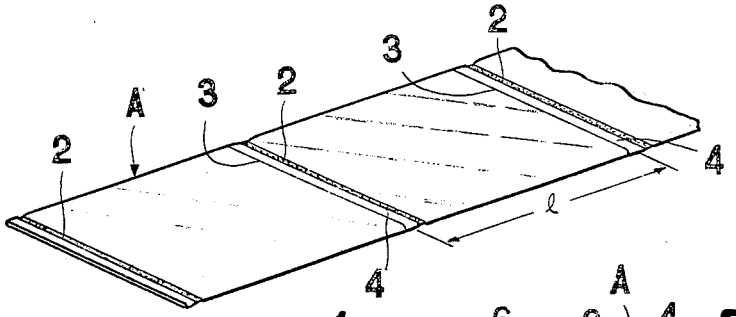
FIG. 2
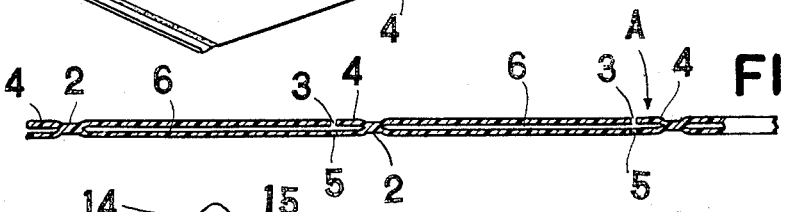
FIG. 3
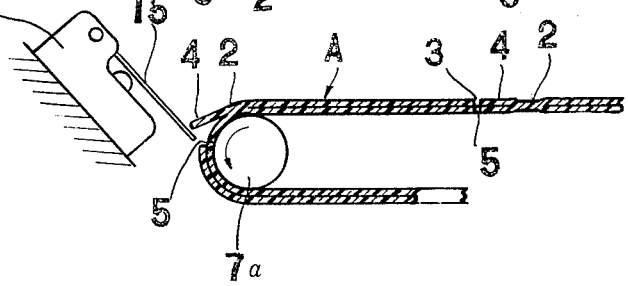
FIG. 4

METHOD OF TRANSFERRING STRIP-LIKE PLASTICS BAG MATERIAL IN PACKING MACHINE

BACKGROUND OF THE INVENTION

1. Field of the Invention

The present invention relates generally to a method of packing comprising the steps of intermittently conveying a strip-like bag material which comprises a series of interconnected plastic bags, packing goods into a foremost bag portion of the strip-like bag material, thereafter sealing the bag portion and separating the sealed bag portion from a subsequent bag portion of the bag material, and more particularly, it relates to a method of conveying such bag material in a packing machine for carrying out said method of packing.

2. Description of the Prior Art

In general, the strip-like bag material as used in packing machines for carrying out such method of packing is of the structure as illustrated in FIGS. 2 and 3. The striplike bag material A shown in these Figures is made of a collapsed film tube of a thermoplastic synthetic resin such as vinyl or polyethylene which is manufactured by an extruder with an inflation device, and comprises a series of interconnected bags 6. The strip-like bag material A is provided with a plurality of transversely extending rectilinear welded portions 2 which form bottoms of the bags 6 and which are formed by heat-sealing the bag material transversely across the same at regular intervals by a heat-sealer. Also, the bag material A is provided, on one side thereof, with transversely extending rectilinear opening portions 3 which are respectively located at portions adjacent to the respective welded portions 2 at regular intervals and in parallel relationship therewith, whereby flap-like margins 4 of the welded portions 2 are formed transversely across the bag material A between the opening portions 3 and the welded portions 2, respectively. Further, the bag material A is provided, on the other side thereof, with easily severable rectilinear fragile portions 5 which are formed across the breadth of said bag material on the other side thereof at portions opposite to the opening portions 3, respectively. In the illustrated embodiment, each of the rectilinear fragile portions 5 takes the form of a row of discontinuous perforations.

Usually, a packing operation with the use of the strip-like bag material A is performed as described below. First, the strip-like bag material A is wound into the form of a roll as shown in FIG. 1, then the rolled bag material is supported on a roll support 13 of a packing machine P and then the leading end of the rolled bag material A is drawn. Thereafter, the bag material A is pinched between a pair of intermittently operated pinching rollers 8 after being passed over a plurality of guide rollers 7 in such a way that its leading end depends from the pinching rollers 8 into a goods-charging device 9 located beneath the same. Under this condition, the bag material A is conveyed, by actuating the pinching rollers 8, for a distance corresponding to the length l of a single bag 6, then during an inoperative interval of the rollers 8, the foremost bag 6 is inflated by actuating an air blower 10 so that goods 11 can be smoothly packed into the foremost bag 6 and then after the goods have been packed, operation of the blower 10 is stopped and the bag is sealed along its opening portion 3 by means of heat-sealers 12 and finally, the goods-charged bag 6 is separated from the subsequent bag 6 of the bag material A at the fragile portion 5 of the goods-charged bag. Thereafter, such packing operation can be repeated by operating the pinching rollers 8.

To ensure intermittent transfer of the strip-like bag material A for a distance corresponding to the length of a single bag, two methods have hitherto been proposed. One of the methods employs photoelectric elements and the other of the methods a pair of electrodes as means for controlling transfer of the bag material, respectively. The former may only be applied in case where printed patterns, letters, register marks or the like are indicated on the respective bags of the bag material, while the latter is applicable only in case where openings, cut-outs or the like are formed in the respective bags. In addition, the former has such drawbacks that when the bag material is transferred at a high speed, such register marks or the like cannot be accurately scanned by the photoelectric means, which causes the bag material to be transferred for a distance not corresponding to the length of a single bag of the bag material, thus causing incomplete packing. Also the provision of the photoelectric means requires a great expense. On the other hand, the latter method has also such additional drawbacks that the use of electrodes requires considerably high voltage which causes a danger of injuring operators and that the scanning capacity of the electrodes is relatively low.

SUMMARY OF THE INVENTION

The present invention is intended to eliminate the drawbacks and inconveniences indicated with the conventional methods and to ensure accurate intermittent transfer of the strip-like bag material for a distance corresponding to the length of a single bag section, irrespective of the fact that it has register marks, etc. or not and is transparent or not, with simple methods and means.

It is, therefore, an object of the present invention to provide an improved method of transferring a strip-like plastics bag material comprising a series of interconnected bags in a packing machine which is capable of intermittently transferring such bag material for a distance corresponding to the length of a single bag with preciseness and reliability without the provision of complicated and/or expensive detecting means as is the case with the conventional methods.

It is other object of the present invention to provide an improved method of transferring such bag material which can be carried out by simple procedures and at a reasonable cost.

Other objects and advantageous features of the present invention will be readily appreciated from the following description taken in conjunction with the accompanying drawings.

BRIEF DESCRIPTION OF THE DRAWINGS

FIG. 1 is a schematic side view of a packing machine for carrying out the method of the present invention;

FIG. 2 is a perspective view, in an enlarged scale, of a part of the strip-like bag material used for carrying out the method of the invention;

FIG. 3 is a vertical cross-sectional side view, in an enlarged scale, of the bag material shown in FIG. 2, taken along the longitudinal axis thereof; and FIG. 4 is an enlarged schematic side view illustrating the state in which a microswitch as a detecting means is operated by a flap-like margin of a welded portion of the bag material.

DESCRIPTION OF THE PREFERRED EMBODIMENT

Referring now to the drawing in FIG. 1, a guide roller *7a* which is one of the several guide rollers provided in the packing machine P is located at an intermediate position of the travelling course of the strip-like bag material A extending from the roll support 13 to the goods-charging device 9.

As shown, the guide roller *7a* is mounted to carry the bag material A so that each of the opening portions 3 of the respective bags 6 is directed outwardly of the guide roller *7a* when passing over the same. Accordingly, the free end of a flap-like margin 4 is caused to be raised slightly above the outer surface of the bag portion as it passes through the guide roller *7a*, as illustrated in FIG. 4.

In the vicinity of guide roller *7a*, there is provided a microswitch 14, of which an elongated contact 15 is arranged to be releasably engaged with the raised margin 4. As contact 15 engages the raised margin, the microswitch is closed to thereby detect welded portion 2 which forms the bottom of a bag 6.

As a detecting signal is received by a control device, not shown, from the microswitch 14, rotation of a motor 16 for driving the pinching rollers 8 is caused to stop. In cases where an electromagnetic clutch is incorporated between the motor 16 and the pinching rollers 8, said clutch is caused to be released in response to the signal. In either case, rotation of the rollers 8 is stopped.

It is to be noted that the position of an adjustment roller *7b* which is one of the guide rollers 7 must be adjusted, when necessary, by displacing the same in the directions as indicated by arrows in FIG. 1 so that the bag section 6 at the leading end of the strip-like bag material A is located exactly at the goods-charging device 9.

In response to the detection of the bottom of a bag section 6 by the microswitch 14, sequential operations are performed which comprise air blowing by the blower 10, charging goods into the expanded bag section, sealing the goods-charged bag section at the opening portion 3 by heat-sealers 12 and separating the sealed bag section from the subsequent bag section at the row of discontinuous openings 5. Then after completion of the above sequential operations the pinching rollers 8 are driven again for the next packing operation.

As may be seen from the foregoing, in accordance with the method of the present invention, detection of travel of the bag material A for a distance corresponding to the length of a single bag 6 can be mechanically effected by engagement of the contact 15 of the microswitch 14 with the flap-like margin 4 of the welded portion 2.

Thus, in accordance with the method of the present invention, the flap-like margin of the welded portion which forms a connection between two adjacent bag sections is automatically detected by means of an inexpensive microswitch each time when the strip-like bag material is conveyed and accordingly, automatic control of intermittent transfer of the bag material for a predermined distance is accurately performed, even if the bag material has neither register marks and the like nor openings for detection.

What I claim is:

1. A method of transferring a strip-like plastic bag material in a packing machine, comprising the steps of: transferring the bag material by a pair of intermittently operated pinching rollers, said bag material comprising a series of interconnected bags each having a heat-sealed bottom portion with a flap-like margin; raising said flap-like margin during transfer of said bag material by guide means; detecting said bottom portion by means of a microswitch having an elongated contact adapted to be releasably engaged with said flap-like margin as said flap-like margin is raised by said guide means during transfer of said bag material; and stopping said bag material for packing operation in response to detection by said microswitch of said bottom portion.

2. A method as set forth in claim 1, wherein said guide means is a guide roller and said microswitch is provided in the vicinity of said guide roller.

3. A method of conveying an elongated strip-like bag material of a collapsed plastic film tube in a packing machine, said bag material comprising a series of interconnected bags each having on one side thereof a transversely extending heat-sealed bottom portion and a transversely extending opposite opening portion parallel therewith, each bag of said material having a flap-like margin formed transversely across the bag material between said opening portion and said heat-sealed bottom portion and also an easily severably fragile portion formed transversely across the bag material on the other side thereof at a portion opposite to said opening portion, said method comprising the steps of conveying said bag material extending from a roll of said bag material and nipped between a pair of intermittently operated pinching rollers for a selected distance at a time, corresponding to the length of a single bag toward a goods-charging device of said packing machine by said pinching rollers via guide means mounted upstream of said pinching rollers for guiding said bag material through a travel path, said guide means having a surface for carrying said bag material so that respective opening portion of the bag material is directed outwardly of said guide means and said flap-like margin is caused to be raised slightly above the surface when passing thereover;

detecting said flap-like margin by means of a microswitch having an elongated contact mounted adjacent the surface of said guide means and arranged to be releasably engageable with said margin responsive to the raising of said margin above the surface during travel of said bag material; and stopping travel of said bag material for sequential packing operations in response to detection by said microswitch of said flap-like portion.

4. A method as set forth in claim 3, wherein said guide means comprises a guide roller.

* * * * *